US009919328B2

(12) United States Patent
Emery, Jr.

(10) Patent No.: US 9,919,328 B2
(45) Date of Patent: Mar. 20, 2018

(54) CONVERTIBLE FLUID CONTAINER NOZZLE

(71) Applicant: James Stephen Emery, Jr., New York, NY (US)

(72) Inventor: James Stephen Emery, Jr., New York, NY (US)

( * ) Notice: Subject to any disclaimer, the term of this patent is extended or adjusted under 35 U.S.C. 154(b) by 0 days.

(21) Appl. No.: 15/142,749

(22) Filed: Apr. 29, 2016

(65) Prior Publication Data

US 2017/0312772 A1 Nov. 2, 2017

(51) Int. Cl.
*B05B 11/00* (2006.01)
*B05B 15/00* (2018.01)

(52) U.S. Cl.
CPC ..... *B05B 11/3059* (2013.01); *B05B 11/3025* (2013.01); *B05B 11/3047* (2013.01); *B05B 15/005* (2013.01)

(58) Field of Classification Search
CPC . B65D 47/065; B65D 47/305; B05B 11/3059; B05B 15/005; B05B 11/3047; B05B 11/3025
USPC ..... 222/534, 533, 327.7, 536
See application file for complete search history.

(56) References Cited

U.S. PATENT DOCUMENTS 4,978,037 A * 12/1990 Schuckmann ..... G01F 11/08 222/260
4,991,744 A * 2/1991 Von Schuckmann ... G01F 11/08 222/136
5,709,318 A * 1/1998 Oder ..... B65D 47/2006 222/153.06
2005/0098584 A1* 5/2005 Do Rosario ..... B65D 83/206 222/321.7

* cited by examiner

*Primary Examiner* — Paul R Durand
*Assistant Examiner* — Robert Nichols, II
(74) *Attorney, Agent, or Firm* — Alston & Bird LLP

(57) ABSTRACT

A fluid container comprises at least two fluid dispensing paths, wherein the fluid container comprises a container body and a fluid dispenser, and the fluid dispenser comprises a dispenser body connected to the container and a bottom portion enclosing the container. The dispenser body comprises a flow path extending through the bottom portion to a flow path exit, and a conduit aperture extending through the bottom portion and configured to accept a flexible conduit therein. A dispenser cap is operably connected to the dispenser body, wherein the dispenser cap comprises a fluid pump configured to pump fluid from the container via the flexible conduit. The dispenser cap is operable between a closed configuration in which the flow path exit is sealed and an open configuration in which the flow path exit is open, enabling fluid to flow out of the container via the flow path.

19 Claims, 7 Drawing Sheets

CONVERTIBLE FLUID CONTAINER NOZZLE

FIELD

Embodiments described herein generally relate to fluid dispensers.

BACKGROUND

Historically, fluid containers may include a dispenser (e.g., integrated into a container body, a cap, and/or the like) for dispensing a fluid in accordance with an anticipated use of the fluid. Typically, a dispenser for a container may be selected based on characteristics of the contained fluid and/or based on an anticipated use of the fluid. For example, lotions, gels, and/or other highly-viscous fluids may be dispensed from containers via various pumps and/or other nozzles that enable the highly-viscous fluid to be directed out of the container in a controlled manner, for example, in response to a user providing an input force (e.g., actuating a pump, squeezing the container, and/or the like). Fluids having lower viscosities may be directed through nebulizing pumps, foaming pumps, high-velocity nozzles, and/or the like for applications in which a user is expected to direct the fluid some distance away from the nozzle.

However, there remains a need in the art for improved fluid containers providing convenient fluid dispensers for users.

BRIEF SUMMARY

Various embodiments are directed to a fluid container. In various embodiments, the fluid container comprises: a container body defining a container interior accessible via a container opening; and a fluid dispenser. In various embodiments, the fluid dispenser comprises: a dispenser body operably connected to the container body, and a dispenser cap operably connected to the dispenser body. In various embodiments, the dispenser body comprises: a bottom portion enclosing the container opening; a flow path extending through the bottom portion between the container interior and a flow path exit; and a conduit aperture extending through the bottom portion. Moreover, in various embodiments, the dispenser cap comprises a fluid pump configured to pump fluid out of the container. In various embodiments, the dispenser cap is operable between: a closed configuration in which the flow path exit is sealed; and an open configuration in which the flow path exit is open. Moreover, in various embodiments, the fluid pump comprises a flexible conduit extending through the conduit aperture into the container interior, wherein the flexible conduit flexes during movement of the dispenser cap between the closed configuration and the open configuration.

In certain embodiments, the fluid pump is a nebulizer. Moreover, in various embodiments, the fluid pump comprises a fluid chamber in fluid communication with the flexible conduit, and a pump head defining an exit conduit in fluid communication with the fluid chamber, wherein the pump head is movable relative to the dispenser cap between an extended position and a compressed position to pump fluid from the fluid chamber and through the exit conduit. In certain embodiments, the fluid chamber comprises a biasing member configured to bias the pump head to the extended position, and a ball valve configured to seal the flexible conduit while the pump head is moved to the compressed position. Moreover, the pump head may comprise a fluid nozzle at an end of the exit conduit opposite the fluid chamber.

In various embodiments, the container body is rigid. Moreover, in various embodiments, the dispenser cap defines a spout, and wherein: the spout seals the flow path exit when the dispenser cap is in the closed configuration; and the spout enables fluid flow from the flow path exit when the dispenser cap is in the open configuration.

In certain embodiments, the dispenser body defines an air vent extending through the bottom portion. Moreover, in various embodiments, the flexible conduit forms a fluid-tight seal with the conduit aperture. In certain embodiments, the bottom portion comprises a canted portion, and wherein the conduit aperture extends through the canted portion. The flexible conduit may define a bend proximate the conduit aperture in certain embodiments, and the bend may change between a first angle when the dispenser cap is in the closed configuration and a second angle when the dispenser cap is in open configuration. In various embodiments, the first angle and the second angle are obtuse.

Various embodiments are directed to a fluid dispenser. In various embodiments, the fluid dispenser comprises a dispenser body and a dispenser cap. The dispenser body may comprise: a bottom portion; a flow path extending through the bottom portion between a flow path entrance and a flow path exit; and a conduit aperture extending through the bottom portion. In various embodiments, the dispenser cap is operably connected to the dispenser body opposite the bottom portion. Moreover, in various embodiments, the dispenser cap comprises a fluid pump and the dispenser cap is operable between: a closed configuration in which the flow path exit is sealed; and an open configuration in which the flow path exit is open. Moreover, in certain embodiments, the fluid pump comprises a flexible conduit extending through the conduit aperture, wherein the flexible conduit flexes during movement of the dispenser cap between the closed configuration and the open configuration. In various embodiments, the fluid pump is a nebulizer.

In various embodiments, the fluid pump comprises a fluid chamber in fluid communication with the flexible conduit, and a pump head defining an exit conduit in fluid communication with the fluid chamber, wherein the pump head is movable relative to the dispenser cap between an extended position and a compressed position to pump fluid from the fluid chamber and through the exit conduit. In various embodiments, the fluid chamber comprises a biasing member configured to bias the pump head to the extended position, and a ball valve configured to seal the flexible conduit while the pump head is moved to the compressed position. Moreover, in various embodiments, the dispenser cap defines a spout, and wherein: the spout seals the flow path exit when the dispenser cap is in the closed configuration; and the spout enables fluid flow from the flow path exit when the dispenser cap is in the open configuration.

In various embodiments, the bottom portion comprises a canted portion, and wherein the conduit aperture extends through the canted portion. The flexible conduit may define a bend proximate the conduit aperture in certain embodiments, and the bend may changes between a first angle when the dispenser cap is in the closed configuration and a second angle when the dispenser cap is in open configuration. In various embodiments, the first angle and the second angle are obtuse.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Various embodiments are directed to a fluid container and associated fluid dispenser defining at least two different dispensing paths for dispensing fluid from a container interior. The fluid dispenser may comprise a fluid pump configured to pump fluid out of the container interior, for example, in response to a user actuating a pump component. For example, the fluid pump may enable the fluid to be sprayed, misted, foamed, and/or the like from a fluid dispenser secured to a top portion of the fluid container while the container is in an upright configuration. Moreover, the fluid dispenser may define a sealable spout through which fluid may be poured or otherwise directed when the spout is in an open configuration. For example, low viscosity fluids may be poured through the spout by tipping the container such that fluid enters the spout (e.g., such that fluid enters the spout due to the force of gravity). Thus, the fluid dispenser provides at least two options by which a user may dispense fluid from the container.

Container Body

Figure 1:
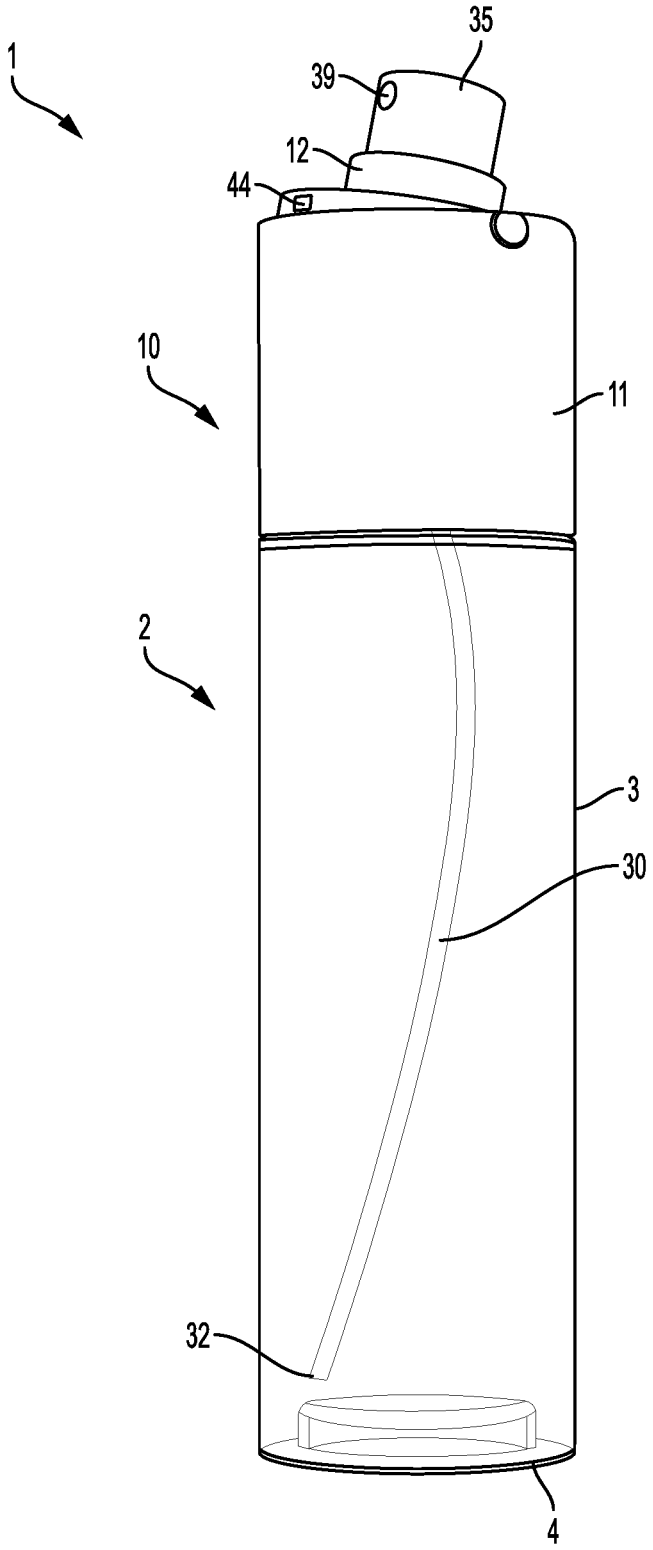
FIG. 1 illustrates an example fluid container in accordance with various embodiments.

FIG. 1 illustrates an example fluid container 1 according to various embodiments. As shown in FIG. 1, the fluid container 1 may comprise a container body 2 and a fluid dispenser 10. In various embodiments, the container body 2 may be transparent, translucent, and/or opaque. The container body 2 may comprise a rigid material (e.g., a rigid plastic, glass, metal, and/or the like). In other embodiments, the container body 2 may comprise a flexible material (e.g., a flexible plastic material) configured such that a user may squeeze the container body 2 to selectably reduce the interior volume of the container body 2 and thereby direct fluid out of the container body 2 (e.g., via the fluid dispenser 10). For example, a user may force a high-viscosity fluid (e.g., a gel, a lotion, and/or the like) out of a fluid spout (described in detail herein) by squeezing the container body 2. In various embodiments, a flexible container body 2 may be biased to a neutral shape, such that the flexible container body 2 is configured to return the neutral shape after a user releases the flexible container body 2 (e.g., after the user stop squeezing the flexible container body 2). In such embodiments, the fluid container 1 may be configured to permit air to enter the container body 2 as the container body 2 returns to the neutral shape to replace the fluid dispensed from the fluid container 1.

In certain embodiments, a flexible container body 2 may be configured to maintain a manipulated shape after a user has released the flexible container body 2. For example, after a user stops squeezing a flexible container body 2, the flexible container body 2 may maintain the compressed/manipulated shape imparted by the user while the flexible container body 2 was squeezed.

Figure 3:
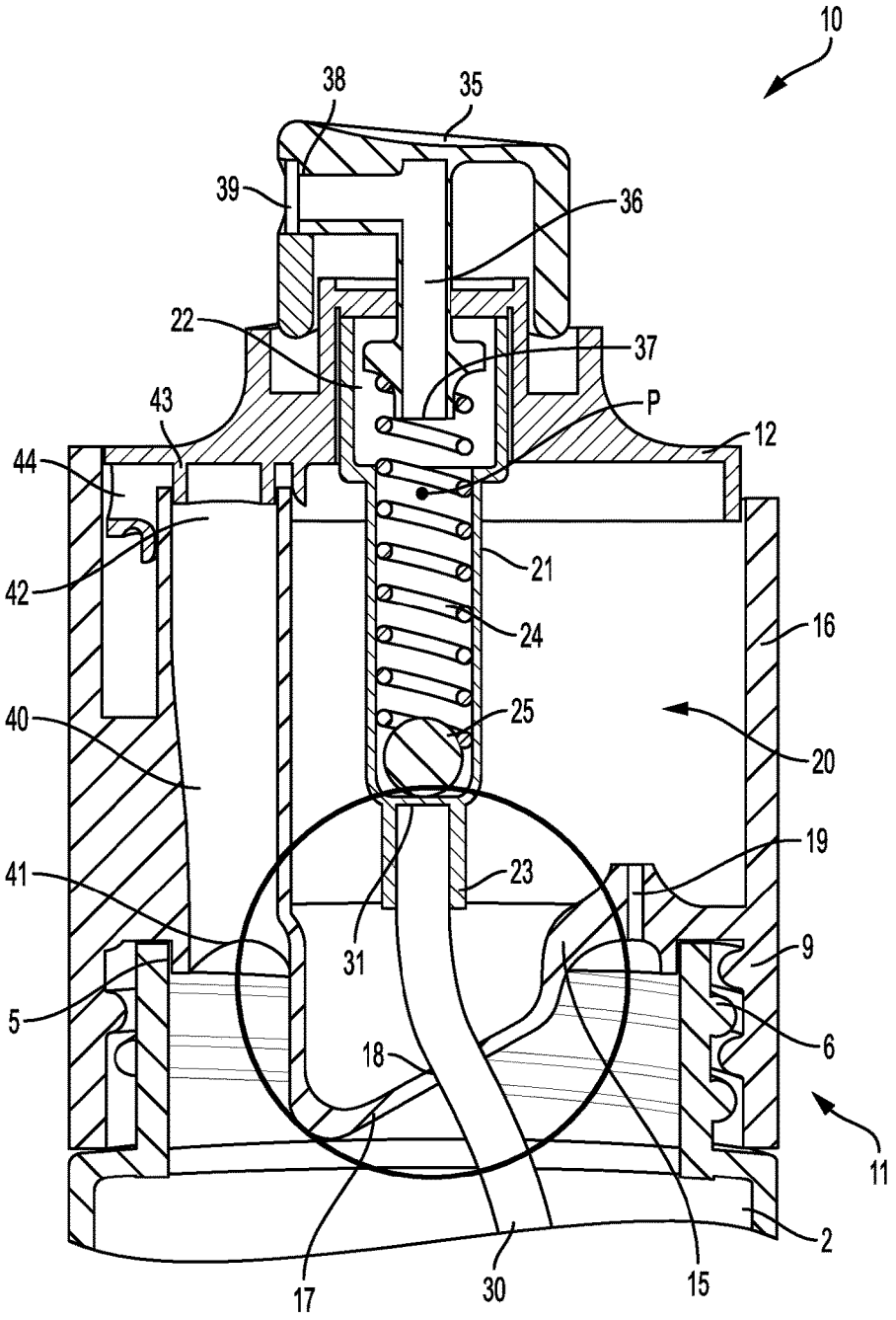
FIG. 3 is a side cut-away view of an example fluid dispenser in a closed configuration in accordance with various embodiments.

With reference again to FIG. 1, the container body 2 may define one or more container walls 3, a closed end 4, and an open end 5 (shown in FIG. 3). For example, in the illustrated embodiment of FIG. 1, the container body 2 may have a generally cylindrical shape having a round container body 2 extending between the closed end 4 and the open end 5 and defining a container interior therein. However, it should be understood that the container body 2 may have any of a variety of shapes. For example, the container body 2 may define an "envelope" shape, in which the one or more container walls 2 converge to join and thereby form the closed end 4. As yet other examples, the container body 2 may comprise a rectangular tube, a pyramid, an oblong shape, and/or the like.

Referring briefly to FIG. 3, the container body 2 may define container engagement features 6 configured to secure the container body 2 relative to the fluid dispenser 10. For example, the container engagement features 6 may comprise threads (e.g., male threads and/or female threads) configured to engage corresponding threads of the fluid dispenser 10. However, the container engagement features 6 may comprise a tapered portion configured to form a friction fit between the container body 2 and the fluid dispenser 10, a snap-ledge configured to form a snap-fit between the container body 2 and the fluid dispenser 10 pressed onto the open end 5 of the container body 2, and/or the like.

Fluid Dispenser

As shown in FIG. 1, a fluid dispenser 10 may be secured to a container body 2 opposite a closed end 4 of the container body 2. As discussed herein, the fluid dispenser 10 defines at least two fluid dispensing paths along which fluid may be directed to dispense fluid from the interior of the container body 2.

Figure 2:
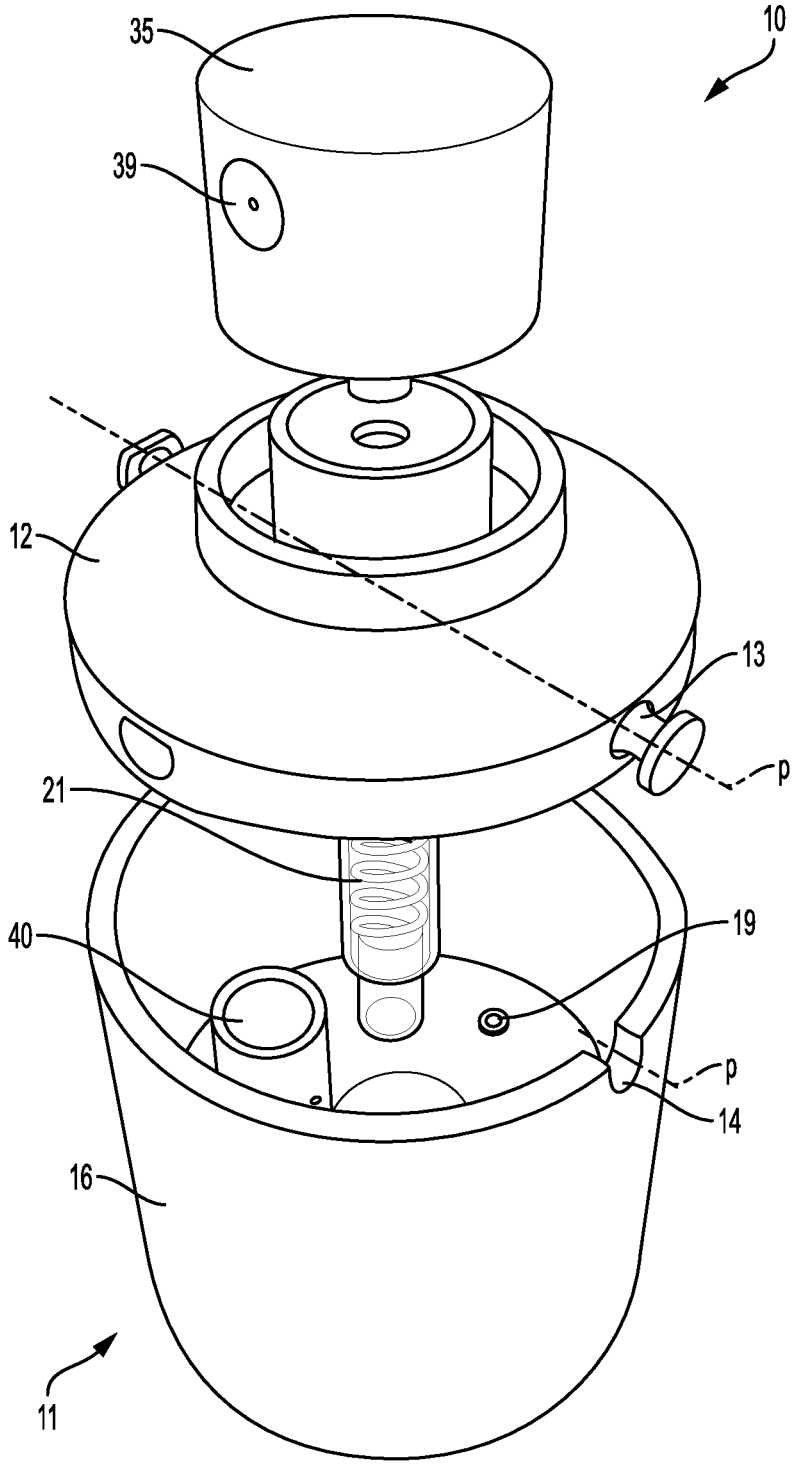
FIG. 2 is an exploded view of an example fluid dispenser in accordance with various embodiments.

FIG. 2 illustrates an exploded view of a fluid dispenser 10 according to various embodiments. As shown in FIG. 2, the fluid dispenser 10 may comprise a dispenser body 11 and a dispenser cap 12. The dispenser body 11 may define a bottom portion 15 configured to extend at least substantially across the open end 5 of the container body 2, and one or more dispenser walls 16 extending away from the bottom portion 15. In various embodiments, the dispenser walls 16 may comprise dispenser engagement features 9 configured to engage the corresponding container engagement features 6 to secure the fluid dispenser 10 relative to the container body 2. The bottom portion 15 may be at least substantially solid and configured to prevent fluid from flowing into an interior portion of the fluid dispenser 10. Accordingly, defined fluid paths (e.g., flow path 40 and/or conduit aperture 18, described in detail herein) may be sealed from the interior of the fluid dispenser 10, such that fluid may not enter the interior of the fluid dispenser 10. As discussed herein, in various embodiments, the bottom portion 15 may be solid with the exception of one or more vent holes 19 configured to permit air to enter the container body 2 during fluid dispensing.

With reference briefly to FIG. 3, the bottom portion 15 may comprise a canted portion 17 that is neither parallel nor perpendicular to the dispenser walls 16 and/or the remaining portions of the bottom portion 15. The canted portion 17 may extend away from the remainder of the bottom portion 15, such that the canted portion is positioned within the interior of the container body 2 when the fluid dispenser 10 is secured relative to the container body 2.

The dispenser cap 12 may be pivotably connected to the dispenser body 11 (e.g., to the body walls 16) such that the dispenser cap 12 may be pivoted between a closed configuration and an open configuration around pivot axis p to selectably enable fluid dispensing through at least one of the fluid dispensing paths (as discussed in greater detail herein). For example, in the illustrated embodiment of FIG. 2, the pivot axis p extends along a lateral middle portion of the fluid dispenser 10.

In various embodiments, the dispenser cap 12 comprises rocker hinge pins 13 concentric with the pivot axis p configured to engage corresponding rocker hinge cavities 14 within the one or more dispenser walls 16 such that the rocker hinge pins 13 are rotatable within the corresponding rocker hinge cavities. As yet other examples, the dispenser cap 12 may be pivotably mounted relative to the dispenser body 11 via dimple hinges defined by a dimple in an interior surface of the dispenser walls 16 and a corresponding protrusion on a sidewall of the dispenser cap 12 configured to engage the dimples of the interior surface of the dispenser walls 16 such that the protrusions are rotatable within the corresponding dimples. In various embodiments, the positioning of the dimples and corresponding protrusions may be reversed, such that the dimples are in a sidewall of the dispenser cap 12 and the protrusions extend away from an interior surface of the dispenser walls 16. Although not shown, the dispenser body 11 may define one or more pivot stops (e.g., extrusions extending away from an interior surface of a dispenser wall 16) configured to limit the pivoting rotation of the dispenser cap 12 relative to the dispenser body 11. For example, the pivot stops may be configured to prevent the dispenser cap 12 from rotating past an open configuration in which a continuous and sealed fluid path exists between a container interior, through a flow path and a spout to the exterior of the container (as discussed in greater detail herein).

With reference again to FIG. 2, the dispenser cap 12 additionally comprises a fluid pump 20 defining a dispensing path for fluid in a container. Components of the fluid pump are shown in greater detail in the sectional views shown in FIGS. 3-4.

As shown in FIG. 3, which illustrates the fluid dispenser 10 in the closed configuration, the fluid pump 20 comprises a fluid chamber 21 positioned at least substantially within the dispenser body 11 and rigidly secured relative the dispenser cap 12; a flexible conduit 30 secured relative the fluid chamber 21 and extending through the bottom portion of the dispenser body 11 and into the container interior; and a pump head 35 linearly moveable relative the dispenser cap 12 and the fluid chamber 21. In various embodiments, the pump head 35 may be rotatable relative to the dispenser cap 12, for example, to change the position of an exit end of an exit conduit extending through the pump head 35 relative to the various components of the fluid container 1.

In various embodiments, the fluid pump 20 may be configured to selectably pump and dispense fluid from an interior of the container body 2, and out through the pump head 35 for use. As just one non-limiting example, the fluid pump 20 may be configured to pump and dispense sun tanning oil from the container interior 2 for application by a user onto his/her skin.

With reference again to FIG. 3, the pump head 35 may be linearly moveable in a direction parallel to, and/or concentric with a central longitudinal axis extending along the length of the fluid chamber 21. The pump head 35 may be movable between an extended configuration (as shown in FIG. 3) and a compressed configuration (not shown). The pump head 35 may define an exit conduit 36 extending therethrough. The exit conduit 36 may extend from an entrance end 37 positioned within the interior of the fluid chamber 21 such that the exit conduit 36 is in fluid communication with the interior of the fluid chamber 21 such that fluid may flow from the fluid chamber 21 into the exit conduit 36 The exit conduit 36 may extend away from the entrance end 37 through the pump head 35 to an exit end 38 open to the environment surrounding the pump head 35. As shown in FIG. 3, the exit conduit 36 may define a corner, such that fluid is directed through an exit end 38 of the exit conduit 36 positioned within a sidewall of the pump head 35. However, it should be understood that in various embodiments, the exit conduit 36 may be at least substantially linear, such that the exit end 38 is positioned on a top surface of the pump head 35. Moreover, as shown in FIG. 3, the pump head 35 may comprise a nozzle 39 positioned adjacent the exit end 38 of the exit conduit 36 The nozzle 39 may provide a desired stream type for the fluid exiting the fluid dispenser 1. For example, the nozzle 39 may define a solid stream, a flat stream, a cone-stream, and/or the like.

In various embodiments, the entrance end 37 of the exit conduit 36 may be sealed within an outlet end 22 of the fluid chamber 21, such that fluid positioned within the fluid chamber 21 cannot escape from the interior of the fluid chamber except through the exit conduit 36. Accordingly, although not shown, the fluid chamber 21 and/or the exit conduit 36 may comprise one or more sealing members (e.g., O-rings, gaskets, and/or the like) configured to seal the fluid chamber 21 (e.g., against portions of the pump head 35 and/or portions of the dispenser cap 12) the to prevent leaks out of the fluid chamber 21 and/or the exit conduit 36.

The fluid chamber 21 may additionally define an inlet end 23, opposite the outlet end 22 along the length of the fluid chamber 21. The inlet end 23 may be configured to receive a first end 31 of the flexible conduit 30 such that fluid may flow between the flexible conduit 30 and the fluid chamber 21. In various embodiments, the first end 31 of the flexible conduit 30 may be frictionally engaged within the inlet end 23 of the fluid chamber 21, thereby forming a fluid-tight seal therebetween. However, any of a variety of attachment interfaces may be defined between the fluid chamber 21 and the flexible conduit 30.

In various embodiments, the fluid chamber 21 may comprise a biasing member 24 and an inlet valve 25 (e.g., a ball valve) therein. The biasing member 24 may be configured to bias the pump head 35 to the extended configuration, and the inlet valve 25 may be configured to selectably seal the inlet end 23 of the fluid chamber 21 while fluid is dispensed through the exit conduit 36.

In operation, depressing the pump head 35 (e.g., with a user's finger) causes the pump head 35 to move from the extended configuration to a compressed configuration. Because the exit conduit 36 is sealed within the fluid chamber 21, depressing the pump head 35 decreases the effective volume within the fluid chamber 21. Simultaneously, the biasing member 24 is compressed, exerting a force against the inlet valve 25 to seal the inlet end 23 of the fluid chamber 21. Accordingly, fluid contained within the fluid chamber 21 is directed into the exit conduit 36 and out of exit end 38 as the pump head 35 is being depressed. Once the pump head 35 is released, the biasing member 24 biases the pump head 35 back to the extended configuration, and releases the compressive force on the inlet valve 25. Although not shown, a one-way valve proximate and/or within the exit conduit 36 may close, preventing air from entering the fluid chamber 21 through the exit conduit 36. Thus, the volume within the fluid chamber 21 increases, forming a vacuum pressure therein. Because air is prevented from entering the fluid chamber via the exit conduit 36, fluid is pulled from the flexible conduit 30 (which is in fluid communication with the interior of the container body 2) into the fluid chamber 21 to refill the fluid chamber 21.

As shown in FIG. 3, the flexible conduit 30 extends through a conduit aperture 18 extending through the bottom portion 15 to a second end 32 (shown in FIG. 1) positioned within the container body 2. In various embodiments, the flexible conduit 30 frictionally engages the conduit aperture 18 to form a fluid-tight seal therebetween, to prevent fluid from leaking out of the container body 2 and into the fluid dispenser 10 between the conduit aperture 18 and the flexible conduit 30. As will be discussed herein, the flexible conduit 30 may be slidable relative to the conduit aperture 18, however, in various embodiments, the flexible conduit 30 may maintain the fluid-tight seal with the conduit aperture 18 while sliding. As shown in FIG. 3, the conduit aperture 18 may extend through the canted portion 17 of the bottom portion 15. Accordingly, the flexible conduit 30 may define a bend between the first end 31 of the flexible conduit 30 (secured relative a fluid chamber 21 as described herein) and the conduit aperture 18. As will be discussed in greater detail herein, maintaining a bend in the flexible conduit 30 facilitates movement of the dispenser cap 12 between the closed position (as shown in FIG. 3) and the open position (as shown in FIG. 4).

As shown in FIG. 1, the second end 32 of the flexible conduit 30 may be positioned proximate the closed end 4 of the container body 2 such that the second end 2 is submerged in fluid while the fluid container 1 is upright until the fluid container 1 is at least substantially empty.

Figure 4:
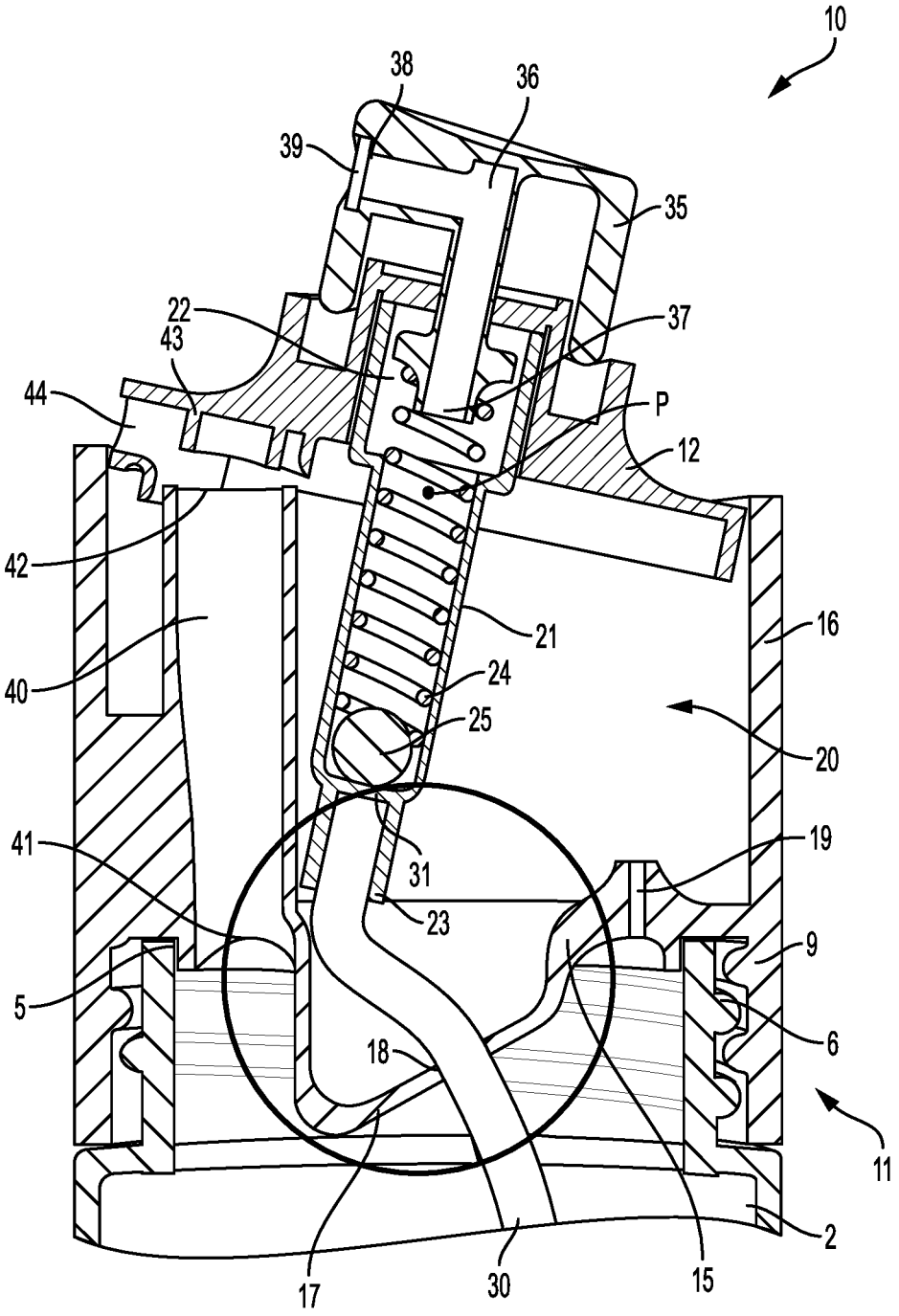
FIG. 4 is a side cut-away view of an example fluid dispenser in an open configuration in accordance with various embodiments.

As discussed herein, the dispenser cap 12 is pivotably mounted relative to the dispenser body 11, between a closed configuration (as shown in FIG. 3) and an open configuration (as shown in FIG. 4). Accordingly, the fluid dispenser 10 is operable to selectively seal or open a flow path 40 to selectably enable fluid to flow from the container interior and into the environment surrounding the fluid container 2. For example, a low viscosity fluid may be poured from the container interior through the flow path 40.

With reference to FIG. 3, the flow path 40 may extend through the bottom portion 15 of the fluid dispenser 10 from a flow path entrance 41 to a flow path exit 42 proximate the dispenser cap 12. In various embodiments, the flow path 40 may extend along at least substantially the entire height of the fluid dispenser interior, between the flow path entrance 41 extending through the bottom portion 15 and the flow path exit 42 proximate a top portion of the fluid dispenser 10. With reference briefly to FIG. 2, the flow path 40 may have a substantially cylindrical shape having a circular cross-section defined by one or more at least substantially smooth sidewalls without ridges and/or protrusions extending therefrom, although the flow path 40 may have any of a variety of shapes having a corresponding cross-section. For example, the cross-section of the flow path 40 may be ovular, rectangular, triangular, and/or the like.

With reference again to FIG. 3, the flow path entrance 41 may be positioned relative to the bottom portion 15 such that the flow path entrance 41 is within the container body 2, past the open end 5 of the container body 2. However, it should be understood that in various embodiments, the flow path entrance 41 may be positioned adjacent the open end 5 of the container body 2. The flow path 40 may extend along the length of the flow path 40 to the flow path exit 42 positioned proximate the dispenser cap 12. As shown in FIG. 3, the cross section of the flow path 40 may vary along the length of the flow path 40, for example, extending from a narrow portion proximate the flow path entrance 41 to a wide portion proximate the flow path exit 42.

In the illustrated embodiment of FIG. 3, the dispenser cap 12 defines a flow path sealing portion 43 configured to seal the flow path exit 42 while the dispenser cap 12 is in the closed position. The flow path sealing portion 43 may comprise a protrusion configured to extend within the interior of the flow path 40 and engage (e.g., frictionally engage) an interior surface of the flow path 40 to provide a fluid-tight seal therebetween. The flow path sealing portion 43 may additionally and/or alternatively comprise a protrusion configured to extend around and engage (e.g., frictionally engage) an exterior surface of the flow path 40 to provide a fluid-tight seal therebetween. Moreover, the flow path sealing portion 43 may additionally define a spout 44 that may be selectably placed in fluid communication with the flow path exit 42. In the closed configuration, as shown in FIG. 3, the fluid is prevented from escaping the flow path 40 to the spout 44, such that the spout 44 is not in fluid communication with the flow path exit 42 when the dispenser cap is in the closed configuration. Moreover, as shown in FIG. 3, the spout 44 may be defined within a portion of a sidewall of the dispenser cap 12, such that when the dispenser cap 12 is in the closed configuration, the spout 44 is positioned within the dispenser walls 16 such that the dispenser walls 16 at least substantially cover the spout 44.

Moreover, as shown in FIG. 3, the flexible conduit 30 may define a bend between the first end 31 of the flexible conduit oriented at least substantially parallel to an axis extending along the length of the fluid chamber 21, and a portion of the flexible conduit 30 extending through the conduit aperture 18, which may be at least substantially perpendicular to a surface of the canted portion 17. The angle of the bend may be dependent on the angle of the canted portion 17 relative to the remainder of the bottom portion 15. In various embodiments, the bend may define an obtuse angle. As shown in FIG. 3, the bend of the flexible conduit 30 may be oriented such that the apex of the bend is angled toward the flow path 40. Accordingly, when the dispenser cap 12 is moved from the closed orientation to the open orientation, the angle of the bend may narrow, however the apex of the bend may remain directed toward the flow path 40. Accordingly, the force necessary to bend the flexible conduit 30 when moving the dispenser cap 12 to the open configuration is minimized, because the flexible conduit 30 need not be flexed through a linear orientation (in which the bend between the first end 31 and the conduit aperture is 180 degrees) when bending between the closed configuration and the open configuration.

The dispenser cap 12 may be moved from the closed configuration (as shown in FIG. 3) to the open configuration (as shown in FIG. 4) by depressing a portion of the top surface of the dispenser cap 12 on a side opposite the flow path sealing portion 43, relative to the pivot axis p. Although not shown, the dispenser cap 12 may comprise one or more indicators (e.g., protrusions, cavities, printed symbols, words, and/or the like) to provide an indicator to a user of an optimal portion of the dispenser cap 12 to depress to pivot the dispenser cap 12 to the open configuration. Moreover, a portion of the dispenser walls 16 proximate the optimal portion of the dispenser cap to depress may be lower than surrounding portions, to facilitate depressing the dispenser cap 12.

When in the open configuration as shown in FIG. 4, in which the dispenser cap 12 is pivoted relative to the dispenser body 11, the flow path sealing portion 43 unseals the flow path exit 42 such that the flow path exit 42 is in fluid communication with the spout 44. Although not shown, the flow path 40 may be sealed from the interior of the fluid dispenser 10, such that fluid is prevented from flowing into the interior of the fluid dispenser 10 (e.g., around the exterior of the fluid chamber 21). As shown in FIG. 4, the spout 44 is moved at least partially beyond the dispenser walls 16, such that fluid may flow from the flow path 40, through the spout 44 and into the environment surrounding the fluid container 1. Moreover, as shown in FIGS. 3-4, the bottom portion 15 may define an air vent 19 extending therethrough. The air vent 19 may be configured to enable air to flow from the interior of the fluid dispenser 10 (which may permit air to flow into the fluid dispenser 10 from the surrounding environment) into the container interior 2. Accordingly, air may be permitted into the container interior 2 via the air vent 19 while fluid is dispensed via the flow path 40 to replace the volume of dispensed fluid. Accordingly, the fluid may be dispensed smoothly and uniformly from the flow path 40 and spout 44.

Moreover, as shown in FIG. 4, while the dispenser cap 12 is in the open configuration, the fluid chamber 21 is pivoted relative to the dispenser body 11 such that the inlet end 23 of the fluid chamber 21 is oriented toward the flow path 40. Consequently, a portion of the flexible conduit 30 is slid through the conduit aperture 18 from the container body 2 into the dispenser interior. Moreover, the bend in the flexible conduit 30 between the first end 31 and the portion extending through the conduit aperture 18 narrows relative to the closed orientation.

Figure 5C:
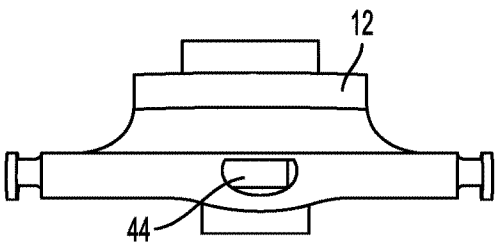
FIGS. 5A-5C are views of example fluid spout configurations in accordance with various embodiments.
Figure 5B:
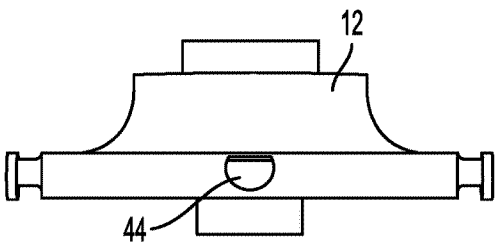
Figure 5A:
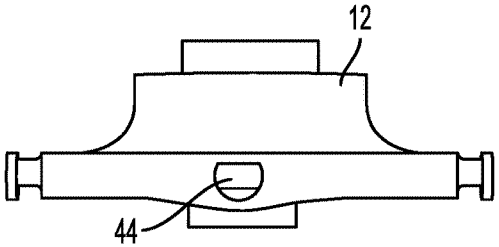

FIGS. 5A-5C illustrate example spout 44 shapes according to various embodiments. As shown in FIGS. 5A-5C, the spout 44 may define a substantially rounded shape, a substantially trapezoidal shape, and/or the like. Indeed, the spout 44 configurations illustrated in FIG. 5A-5C are merely examples, as the spout 44 may have any of a variety of shapes, including circular, triangular, rectangular, and/or the like.

Figure 6:
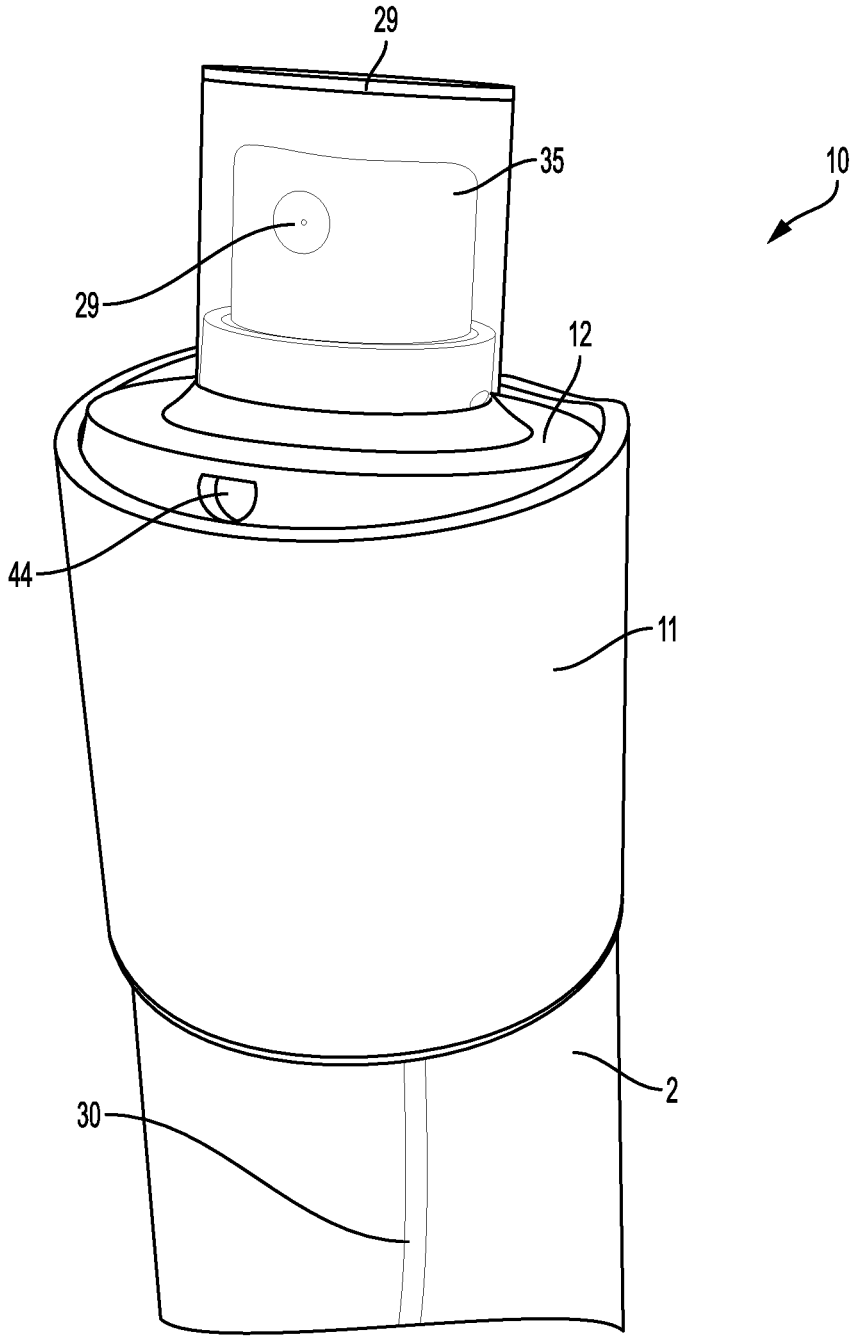
FIG. 6 illustrates an example fluid container having a fluid dispenser in an open configuration in accordance with various embodiments.

FIG. 6 is a perspective view of a fluid dispenser 10 in an open configuration. As shown in FIG. 6, at least substantially all of the spout 44 is positioned beyond the dispenser walls 16 when in the open configuration. Moreover, as shown in FIG. 6, the fluid dispenser 10 may additionally comprise a protective cap 29 secured around the pump head 35. The protective cap 29 may comprise an at least substantially rigid material (e.g., a plastic material) configured to impede incidental depression of the pump head 35. In various embodiments, the protective cap 29 may removably secured relative to the dispenser cap 12. However, in various embodiments, the protective cap may be pivotably secured to the dispenser cap 12, such that the protective cap 29 may be pivoted between a protective configuration in which the protective cap 29 encloses the pump head 35 and an access configuration in which the protective cap 29 is pivoted to permit access to the pump head 35.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

Figure 7:
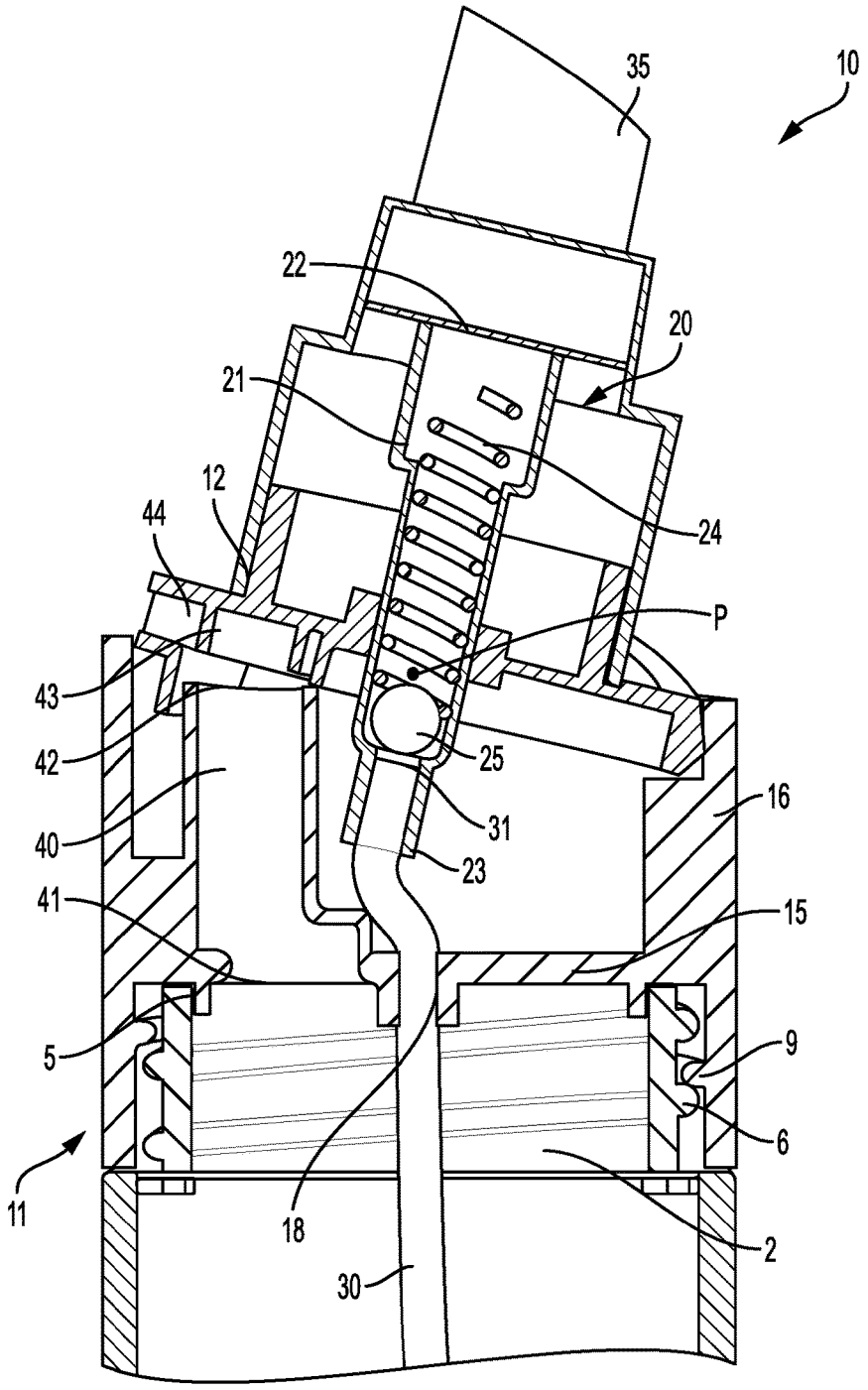
FIG. 7 is a side-cutaway view of a fluid dispenser in an open configuration in accordance with various embodiments.

For example, as shown in FIG. 7, the bottom portion 15 may not define a canted portion, and accordingly the flexible conduit 30 may be configured to flex between a linear configuration when the dispenser cap 12 is in a closed configuration and a bent configuration when the dispenser cap 12 is in an open configuration. Moreover, the fluid chamber 21 may be positioned within an interior portion of the dispenser cap 12 sealed from the interior portion of the dispenser body 11. Moreover, the one or more sidewalls of the flow path 40 may not be smooth, having at least one ridge extending therefore toward the interior of the flow path 40.

That which is claimed:

1. A fluid container comprising:

a container body defining a container interior accessible via a container opening; and a fluid dispenser comprising:

a dispenser body operably connected to the container body, wherein the dispenser body comprises:

a bottom portion enclosing the container opening;

a flow path extending through the bottom portion between the container interior and a flow path exit; and a conduit aperture extending through the bottom portion; and a dispenser cap operably connected to the dispenser body, wherein the dispenser cap comprises a fluid pump configured to pump fluid out of the container; and wherein the dispenser cap is operable between:

a closed configuration in which the flow path exit is sealed; and an open configuration in which the flow path exit is open;

wherein the fluid pump comprises a flexible conduit extending through the conduit aperture into the container interior, wherein the flexible conduit flexes during movement of the dispenser cap between the closed configuration and the open configuration; and wherein the fluid pump comprises a fluid chamber in fluid communication with the flexible conduit, and a pump head defining an exit conduit in fluid communication with the fluid chamber, wherein the pump head is movable relative to the dispenser cap between an extended position and a compressed position to pump fluid from the fluid chamber and through the exit conduit.

2. The fluid container of claim 1, wherein the fluid pump is a nebulizer.

3. The fluid container of claim 1, wherein the fluid chamber comprises a biasing member configured to bias the pump head to the extended position, and a ball valve configured to seal the flexible conduit while the pump head is moved to the compressed position.

4. The fluid container of claim 1, wherein the pump head comprises a fluid nozzle at an end of the exit conduit opposite the fluid chamber.

5. The fluid container of claim 1, wherein the container body is rigid.

6. The fluid container of claim 1, wherein the dispenser cap defines a spout, and wherein:

the spout seals the flow path exit when the dispenser cap is in the closed configuration; and the spout enables fluid flow from the flow path exit when the dispenser cap is in the open configuration.

7. The fluid container of claim 1, wherein the dispenser body defines an air vent extending through the bottom portion.

8. The fluid container of claim 1, wherein the flexible conduit forms a fluid-tight seal with the conduit aperture.

9. The fluid container of claim 1, wherein the bottom portion comprises a canted portion, and wherein the conduit aperture extends through the canted portion.

10. The fluid container of claim 9, wherein the flexible conduit defines a bend proximate the conduit aperture, and wherein the bend changes between a first angle when the dispenser cap is in the closed configuration and a second angle when the dispenser cap is in open configuration.

11. The fluid container of claim 10, wherein the first angle and the second angle are obtuse.

12. A fluid dispenser comprising:

a dispenser body comprising:

a bottom portion;

a flow path extending through the bottom portion between a flow path entrance and a flow path exit;

a conduit aperture extending through the bottom portion; and a dispenser cap operably connected to the dispenser body opposite the bottom portion, wherein the dispenser cap comprises a fluid pump and wherein the dispenser cap is operable between:

a closed configuration in which the flow path exit is sealed; and an open configuration in which the flow path exit is open;

wherein the fluid pump comprises a flexible conduit extending through the conduit aperture, wherein the flexible conduit flexes during movement of the dispenser cap between the closed configuration and the open configuration; and wherein the fluid pump comprises a fluid chamber in fluid communication with the flexible conduit, and a pump head defining an exit conduit in fluid communication with the fluid chamber, wherein the pump head is movable relative to the dispenser cap between an extended position and a compressed position to pump fluid from the fluid chamber and through the exit conduit.

13. The fluid dispenser of claim 12, wherein the fluid pump is a nebulizer.

14. The fluid dispenser of claim 12, wherein the fluid chamber comprises a biasing member configured to bias the pump head to the extended position, and a ball valve configured to seal the flexible conduit while the pump head is moved to the compressed position.

15. The fluid dispenser of claim 12, wherein the dispenser cap defines a spout, and wherein:

the spout seals the flow path exit when the dispenser cap is in the closed configuration; and the spout enables fluid flow from the flow path exit when the dispenser cap is in the open configuration.

16. The fluid dispenser of claim 12, wherein the bottom portion comprises a canted portion, and wherein the conduit aperture extends through the canted portion.

17. The fluid dispenser of claim 16, wherein the flexible conduit defines a bend proximate the conduit aperture, and wherein the bend changes between a first angle when the dispenser cap is in the closed configuration and a second angle when the dispenser cap is in open configuration.

18. The fluid dispenser of claim 17, wherein the first angle and the second angle are obtuse.

19. A fluid dispenser comprising:

a dispenser body comprising:

a bottom portion comprising a canted portion;

a flow path extending through the bottom portion between a flow path entrance and a flow path exit;

a conduit aperture extending through the canted portion of the bottom portion; and a dispenser cap operably connected to the dispenser body opposite the bottom portion, wherein the dispenser cap comprises a fluid pump and wherein the dispenser cap is operable between:

a closed configuration in which the flow path exit is sealed; and an open configuration in which the flow path exit is open;

wherein the fluid pump comprises a flexible conduit extending through the conduit aperture, wherein the flexible conduit flexes during movement of the dispenser cap between the closed configuration and the open configuration.

* * * * *